US008456397B2

(12) United States Patent
Kim et al.

(10) Patent No.: US 8,456,397 B2
(45) Date of Patent: Jun. 4, 2013

(54) APPARATUS AND METHOD FOR CALIBRATING GRAYSCALE DATA USING AN OVERDRIVE METHOD, PRE-TILT METHOD, AND AN UNDERSHOOT METHOD

(75) Inventors: Sung-soo Kim, Suwon-si (KR); Kyu-chan Lee, Seoul (KR); Hyeong-sik Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 815 days.

(21) Appl. No.: 12/476,716

(22) Filed: Jun. 2, 2009

(65) Prior Publication Data

US 2010/0085387 A1 Apr. 8, 2010

(30) Foreign Application Priority Data

Oct. 2, 2008 (KR) ..... 10-2008-0097227

(51) Int. Cl.
*G09G 3/36* (2006.01)
*G09G 5/10* (2006.01)

(52) U.S. Cl.
USPC ..... 345/89; 345/690

(58) Field of Classification Search
USPC ..... 345/89, 690
See application file for complete search history.

(56) References Cited

U.S. PATENT DOCUMENTS 7,362,296 B2 * 4/2008 Song et al. ..... 345/89
7,471,365 B2 * 12/2008 Chang et al. ..... 349/139
7,570,239 B2 * 8/2009 Cheon et al. ..... 345/87
7,839,369 B2 * 11/2010 Chang et al. ..... 345/89
7,839,375 B2 * 11/2010 Lee et al. ..... 345/87
2003/0095090 A1 * 5/2003 Ham ..... 345/87
2003/0179175 A1 * 9/2003 Shigeta et al. ..... 345/101
2004/0119730 A1 * 6/2004 Ham et al. ..... 345/692
2004/0196274 A1 * 10/2004 Song et al. ..... 345/204
2004/0263450 A1 * 12/2004 Lee et al. ..... 345/87
2004/0263495 A1 * 12/2004 Sugino et al. ..... 345/204
2005/0001802 A1 * 1/2005 Lee ..... 345/89
2005/0068343 A1 * 3/2005 Pan et al. ..... 345/690
2005/0083353 A1 * 4/2005 Maruyama et al. ..... 345/690
2005/0093803 A1 * 5/2005 Cheon et al. ..... 345/92

(Continued)

FOREIGN PATENT DOCUMENTS

EP 1467346 A2 10/2004
WO WO 2006/135025 * 12/2006

OTHER PUBLICATIONS

Song J-K et al: "DCCII: Novel Method for Fast Response Time in PVA Mode" 2004 SID International Symposium Digest of Technical Papers. Seattle, WA, May 25-27, 2004; [SID International Symposium Digest of Technical Papers], San Jose, CA : SID, US, vol. 35, No. 2, May 26, 2004, pp. 1344-1347, XP001222866 * p. 2-p. 3; figures 4-6 *.

(Continued)

*Primary Examiner* — Adam J Snyder
(74) *Attorney, Agent, or Firm* — Sughrue Mion, PLLC

(57) ABSTRACT

A display apparatus for calibrating a grayscale data including a timing controller, and a method for driving a panel are provided. A display apparatus includes a timing controller which calibrates the grayscale data of the current frame using the grayscale data of the previous and the current frame and a driving unit which drives a panel using the calibrated grayscale data of the current frame. By generating calibrated grayscale data which are variable according to the change of grayscale, response times of liquid crystal may be improved.

20 Claims, 10 Drawing Sheets

U.S. PATENT DOCUMENTS

2005/0275611 A1* 12/2005 Aoki ..... 345/96
2006/0038952 A1* 2/2006 Chang et al. ..... 349/139
2006/0050038 A1* 3/2006 Cheon et al. ..... 345/89
2006/0071927 A1* 4/2006 Chang et al. ..... 345/87
2006/0103682 A1* 5/2006 Kunimori et al. ..... 345/690
2006/0158416 A1* 7/2006 Ku ..... 345/98
2006/0209095 A1* 9/2006 Hsu ..... 345/690
2006/0274162 A1* 12/2006 Fujishiro ..... 348/229.1
2007/0046597 A1* 3/2007 Park et al. ..... 345/87
2007/0070015 A1* 3/2007 Chang et al. ..... 345/94
2007/0146394 A1* 6/2007 Ahn ..... 345/690
2007/0164949 A1* 7/2007 Lee et al. ..... 345/87
2007/0216624 A1 9/2007 Kimura
2007/0285366 A1* 12/2007 Ha et al. ..... 345/87
2007/0285371 A1* 12/2007 Nam et al. ..... 345/98
2008/0068318 A1* 3/2008 Kerwin ..... 345/89
2008/0123987 A1* 5/2008 Shen et al. ..... 382/255
2008/0158119 A1 7/2008 Park et al.
2008/0211755 A1* 9/2008 Song et al. ..... 345/87
2008/0284699 A1* 11/2008 Yano et al. ..... 345/89
2009/0085856 A1* 4/2009 Okada et al. ..... 345/94
2009/0153456 A1* 6/2009 Tsai et al. ..... 345/89

OTHER PUBLICATIONS

Extended European Search Report issued on Jun. 14, 2010 in counterpart European Application No. 09164051.6.

* cited by examiner

FIG. 6

| | | N-1TH FRAME GRAYSCALE DATA | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| NTH FRAME GRAYSCALE DATA | 0 | 000 | 000 | 000 | 000 | 000 | 000 | 000 | 000 | 000 | 000 | 000 | 000 | 000 | 000 | 000 | 000 | 000 |
| | 16 | 027 | 016 | 012 | 011 | 009 | 008 | 007 | 007 | 006 | 006 | 006 | 006 | 006 | 006 | 005 | 005 | 004 |
| | 32 | 081 | 049 | 032 | 025 | 022 | 019 | 017 | 015 | 014 | 013 | 013 | 012 | 012 | 010 | 009 | 009 | 008 |
| | 48 | 106 | 074 | 056 | 048 | 043 | 037 | 033 | 030 | 028 | 023 | 020 | 018 | 017 | 016 | 014 | 012 | 012 |
| | 64 | 124 | 095 | 079 | 070 | 064 | 059 | 056 | 050 | 047 | 044 | 039 | 035 | 032 | 028 | 025 | 022 | 019 |
| | 80 | 138 | 113 | 100 | 091 | 085 | 080 | 077 | 073 | 067 | 066 | 062 | 057 | 055 | 050 | 046 | 043 | 039 |
| | 96 | 150 | 129 | 118 | 110 | 105 | 101 | 096 | 093 | 090 | 087 | 083 | 079 | 075 | 071 | 067 | 064 | 061 |
| | 112 | 162 | 145 | 134 | 127 | 123 | 119 | 116 | 112 | 109 | 105 | 103 | 101 | 098 | 097 | 093 | 093 | 092 |
| | 128 | 173 | 159 | 150 | 144 | 140 | 137 | 134 | 131 | 128 | 125 | 123 | 119 | 117 | 115 | 113 | 111 | 109 |
| | 144 | 183 | 171 | 165 | 160 | 157 | 154 | 152 | 149 | 147 | 144 | 142 | 141 | 139 | 137 | 136 | 135 | 134 |
| | 160 | 193 | 184 | 179 | 177 | 174 | 172 | 170 | 167 | 165 | 163 | 160 | 159 | 157 | 155 | 154 | 150 | 160 |
| | 176 | 203 | 197 | 193 | 191 | 189 | 187 | 185 | 183 | 182 | 179 | 178 | 176 | 174 | 173 | 172 | 170 | 170 |
| | 192 | 214 | 210 | 207 | 205 | 203 | 202 | 201 | 200 | 199 | 197 | 196 | 194 | 192 | 190 | 190 | 190 | 190 |
| | 208 | 226 | 222 | 220 | 219 | 218 | 217 | 216 | 215 | 214 | 213 | 211 | 210 | 209 | 208 | 207 | 206 | 205 |
| | 224 | 239 | 236 | 234 | 233 | 232 | 231 | 231 | 230 | 230 | 229 | 228 | 227 | 226 | 225 | 224 | 223 | 221 |
| | 240 | 255 | 248 | 247 | 246 | 245 | 245 | 245 | 244 | 244 | 243 | 243 | 242 | 242 | 241 | 241 | 240 | 240 |
| | 255 | 255 | 255 | 255 | 255 | 255 | 255 | 255 | 255 | 255 | 255 | 255 | 255 | 255 | 255 | 255 | 255 | 255 |

FIG. 9

| | | N-1TH FRAME GRAYSCALE DATA | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| NTH FRAME GRAYSCALE DATA | 0 | 000 | 000 | 000 | 000 | 000 | 000 | 000 | 000 | 000 | 000 | 000 | 000 | 000 | 000 | 000 | 000 | 000 |
| | 16 | 013 | 016 | 016 | 016 | 016 | 016 | 016 | 016 | 020 | 020 | 020 | 020 | 016 | 016 | 016 | 016 | 016 |
| | 32 | 022 | 029 | 032 | 032 | 032 | 032 | 032 | 032 | 036 | 036 | 036 | 036 | 036 | 036 | 036 | 036 | 036 |
| | 48 | 036 | 043 | 048 | 048 | 048 | 048 | 048 | 048 | 050 | 050 | 051 | 051 | 051 | 051 | 051 | 051 | 051 |
| | 64 | 051 | 057 | 061 | 064 | 064 | 064 | 064 | 064 | 064 | 064 | 064 | 064 | 064 | 064 | 064 | 064 | 064 |
| | 80 | 065 | 072 | 076 | 078 | 080 | 080 | 080 | 080 | 080 | 080 | 080 | 080 | 080 | 080 | 080 | 080 | 080 |
| | 96 | 083 | 089 | 092 | 096 | 096 | 096 | 096 | 096 | 102 | 096 | 096 | 096 | 096 | 096 | 096 | 096 | 096 |
| | 112 | 101 | 109 | 110 | 112 | 112 | 112 | 112 | 112 | 112 | 115 | 115 | 115 | 115 | 115 | 115 | 115 | 115 |
| | 128 | 113 | 121 | 122 | 128 | 128 | 128 | 128 | 128 | 128 | 128 | 128 | 132 | 132 | 132 | 132 | 132 | 132 |
| | 144 | 125 | 139 | 141 | 144 | 144 | 144 | 144 | 144 | 144 | 144 | 144 | 144 | 144 | 144 | 144 | 144 | 144 |
| | 160 | 145 | 155 | 157 | 160 | 160 | 160 | 160 | 160 | 160 | 160 | 160 | 160 | 160 | 160 | 160 | 160 | 160 |
| | 176 | 151 | 170 | 172 | 176 | 176 | 176 | 176 | 176 | 176 | 176 | 176 | 176 | 176 | 176 | 176 | 176 | 176 |
| | 192 | 172 | 189 | 192 | 192 | 192 | 192 | 192 | 192 | 192 | 192 | 192 | 192 | 192 | 192 | 192 | 192 | 192 |
| | 208 | 160 | 200 | 203 | 208 | 208 | 208 | 208 | 208 | 208 | 208 | 208 | 208 | 208 | 208 | 208 | 208 | 208 |
| | 224 | 160 | 215 | 218 | 224 | 224 | 224 | 224 | 224 | 224 | 224 | 224 | 224 | 224 | 224 | 224 | 224 | 224 |
| | 240 | 100 | 226 | 232 | 240 | 240 | 240 | 240 | 240 | 240 | 240 | 240 | 240 | 240 | 240 | 240 | 240 | 240 |
| | 255 | 255 | 255 | 255 | 255 | 255 | 255 | 255 | 255 | 255 | 255 | 255 | 255 | 255 | 255 | 255 | 255 | 255 |

APPARATUS AND METHOD FOR CALIBRATING GRAYSCALE DATA USING AN OVERDRIVE METHOD, PRE-TILT METHOD, AND AN UNDERSHOOT METHOD

CROSS-REFERENCE TO RELATED APPLICATIONS

This application claims priority under 35 U.S.C. §119 from Korean Patent Application No. 10-2008-0097227, filed on Oct. 2, 2008, in the Korean Intellectual Property Office, the disclosure of which is incorporated herein by reference in its entirety.

BACKGROUND OF THE INVENTION

1. Field of the Invention

Apparatuses and methods consistent with the present invention relate to a display apparatus, a timing controller, and a method for driving a panel using the same, and more particularly, to a display apparatus, a timing controller and a method for driving a panel to calibrate grayscale data of the current frame.

2. Description of the Related Art

In recent years, as the global trend of preferring a large-sized television continues, users are now able to view images through a larger screen. The trend towards a larger television has been accelerated by the development of TFT LCD (Thin Film Transistor Liquid Crystal Display) and PDP (Plasma Display Panel), two leading products in flat panel display. LCD is a display apparatus designed to obtain picture signal by applying electric field to liquid crystal with anisotropy dielectric between two panels and changing the alignment of liquid crystal, which is made possible by adjusting the strength of electric field and thus, the amount of light passing through the panels. LCD consumes less power compared to PDP and has lighter weight. However, it has longer response times because of the realignment of liquid crystal. Therefore, there is a need for methods for improving response times of liquid crystal.

SUMMARY OF THE INVENTION

Exemplary embodiments of the present invention address at least the above problems and/or disadvantages and other disadvantages not described above. Also, the present invention is not required to overcome the disadvantages described above, and an exemplary embodiment of the present invention may not overcome any of the problems described above.

The present invention provides a display apparatus, a timing controller, and a method for driving a panel using the same to improve response times by calibrating the grayscale data of the current frame.

According to an exemplary aspect of the present invention, a display apparatus for calibrating grayscale data of a current frame using the grayscale data of a previous frame and the current frame comprises a timing controller which calibrates the grayscale data of the current frame by changing the grayscale data of the current frame to first calibration data, second calibration data, and third calibration data using an overdrive method, a pre-tilt method, an undershoot method and calculating the first calibration data, the second calibration data and the third calibration data, a driving unit which drives a panel using the calibrated grayscale data of the current frame.

The timing controller may add weighted values to the first calibration data, the second calibration data and the third calibration data and sum up the first calibration data, the second calibration data and the third calibration data to which weighted values are added to calibrate the grayscale data of the current frame.

The first calibration data, the second calibration data and the third calibration data may be determined based on a pre-stored look-up table.

The display apparatus may further comprise a storage unit which stores the grayscale data of the previous frame, and the timing controller may store the calibrated grayscale data of the current frame in the storage unit.

According to the overdrive method, a level of the grayscale data of the current frame may increase if the grayscale data level of the previous frame is lower than the grayscale data level of the current frame, and the level of the grayscale data of the current frame may decrease if the grayscale data level of the previous frame is higher than the grayscale data level of the current frame.

According to the pre-tilt method, a level of the grayscale data of the previous frame may increase if the grayscale data level of the previous frame is lower than the grayscale data level of the current frame, and the level of the grayscale data of the previous frame may decrease if the grayscale data level of the previous frame is higher than the grayscale data level of the current frame.

According to the undershoot method, a level of the grayscale data level of the current frame may decrease if the grayscale data level of the previous frame is lower than the grayscale data level of the current frame, and the level of the grayscale data of the current frame may increase if the grayscale data level of the previous frame is higher than the grayscale data level of the current frame.

Herein, the display apparatus may be a liquid crystal display device.

According to an exemplary aspect of the present invention, a method for driving a panel to calibrate grayscale data of a current frame using the grayscale data of a previous and the current frame comprises steps of changing the grayscale data of the current frame to first calibration data, second calibration data, and third calibration data using an overdrive method, a pre-tilt method, and an undershoot method, calibrating the grayscale data of the current frame by calculating the first calibration data, the second calibration data and the third calibration data, and driving a panel using the calibrated grayscale data of the current frame.

The calibrating may comprise steps of adding weighted values to the first calibration data, the second calibration data and the third calibration data, calibrating the grayscale data of the current frame by summing up the first calibration data, the second calibration data and the third calibration data to which weighted values are added.

The first calibration data, the second calibration data and the third calibration data may be determined based on a previously stored look-up table.

The method for driving a panel may further comprise steps of storing the calibrated grayscale data of the current frame once the grayscale data of the current frame have been calibrated.

The changing may generate the first calibrated data by increasing a level of the grayscale data of the current frame if the grayscale data level of the previous frame is lower than the grayscale data level of the current frame, and decreasing the level of the grayscale data of the current frame if the grayscale data level of the previous frame is higher than the grayscale data level of the current frame.

The changing may generate the second calibrated data by increasing a level of the grayscale data of the previous frame if the grayscale data level of the previous frame is lower than the grayscale data level of the current frame, and decreasing the level of the grayscale data of the previous frame if the grayscale data level of the previous frame is higher than the grayscale data level of the current frame.

The changing may generate the third calibrated data by decreasing a level of the grayscale data of the current frame if the grayscale data level of the previous frame is lower than the grayscale data level of the current frame, and increasing the level of the grayscale data of the current frame if the grayscale data level of the previous frame is higher than the grayscale data level of the current frame.

A timing controller to calibrate grayscale data of a current frame using the grayscale data of a previous frame and the current frame comprises a first generation unit which generates first calibrated grayscale data using an overdrive method, a second generation unit which generates second calibrated grayscale data using a pre-tilt method, a third generation unit which generates third calibrated grayscale data using an undershoot method, and an integrated calibration unit which calibrates the grayscale data of the current frame using the first calibration data, the second calibration data and the third calibration data which are output from the first generation unit, the second generation unit and the third generation unit, respectively.

The timing controller may comprise a storage unit which stores the grayscale data of the previous frame, and the integrated calibration unit directs the calibrated grayscale data of the current frame to be stored in the storage unit.

If the current frame is an Nth frame, the first generation unit and the third generation unit may generate the first calibration data and the third calibration data, respectively, using the Nth frame and a N−1th frame, and the second generation unit may generate the second calibration data using the Nth frame, the N−1th frame, and a N−2th frame.

The integrated calibration unit may add weighted values to the first calibration data, the second calibration data and the third calibration data and sum up the first calibration data, the second calibration data and the third calibration data to which weighted values have been added.

The timing controller may comprise a storage unit which stores levels of the first calibration data level, the second calibration data and the third calibration data based on the grayscale data of the previous frame and the grayscale data of the current frame as a look-up table.

BRIEF DESCRIPTION OF THE DRAWINGS

The above and/or other aspects of the present invention will be more apparent by describing certain exemplary embodiments of the present invention with reference to the accompanying drawings, in which:

FIG. 6 is a schematic perspective view illustrating the first look-up table used for the overdrive method.

FIG. 9 is a schematic perspective view illustrating the third look-up table used for an undershoot method.

DETAILED DESCRIPTION OF EXEMPLARY EMBODIMENTS OF THE INVENTION

Figure 1:
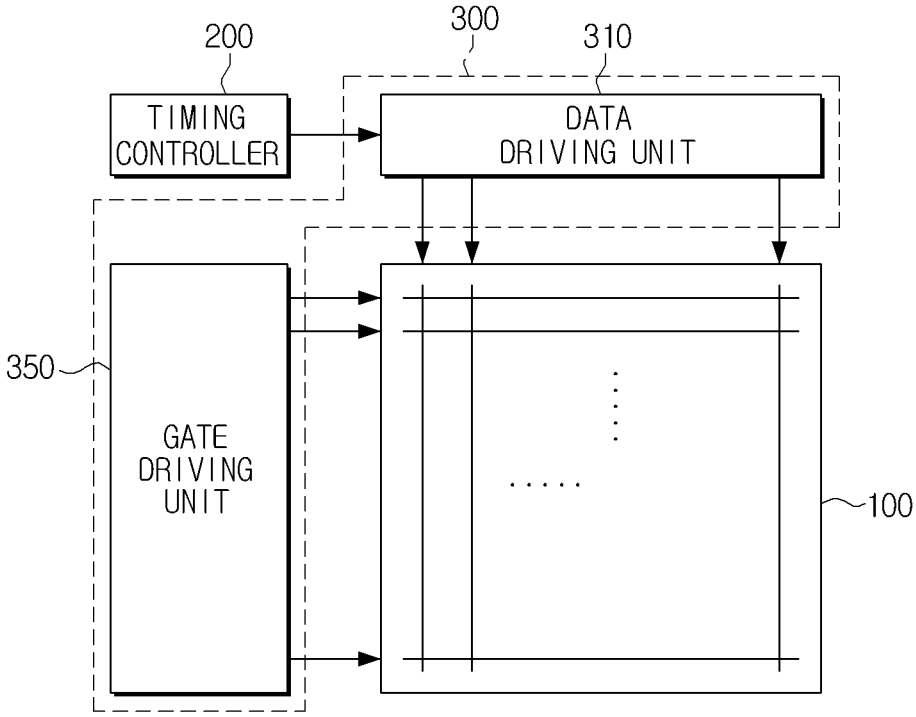
FIG. 1 is a schematic perspective view illustrating a display apparatus to which the present invention is applicable.

Certain exemplary embodiments of the present invention will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

FIG. 1 is a schematic perspective view of a display apparatus to which the present invention is applicable. A display apparatus, according to an exemplary embodiment of the present invention, receives the frame of an image signal, calibrates the grayscale data of a certain pixel from the frame received, and displays a screen corresponding to the calibrated grayscale data.

As shown in FIG. 1, a display apparatus comprises a panel unit 100, a timing controller 200, and a driving unit 300.

The panel unit 100 comprises a plurality of gate lines and data lines, and a plurality of pixels formed where those lines are crossed.

A data line receives from the data driving unit 310 data voltage which is transformed from grayscale data and applies the data voltage to a pixel. The data driving unit 310 will be explained below.

A gate line receives gate on voltage from the gate driving unit 350 and applies it to a pixel. The gate driving unit 350 will be explained below.

Pixels are formed where gate lines for applying gate on voltage and data lines for applying data voltage corresponding to the calibrated grayscale data are crossed.

Figure 2:
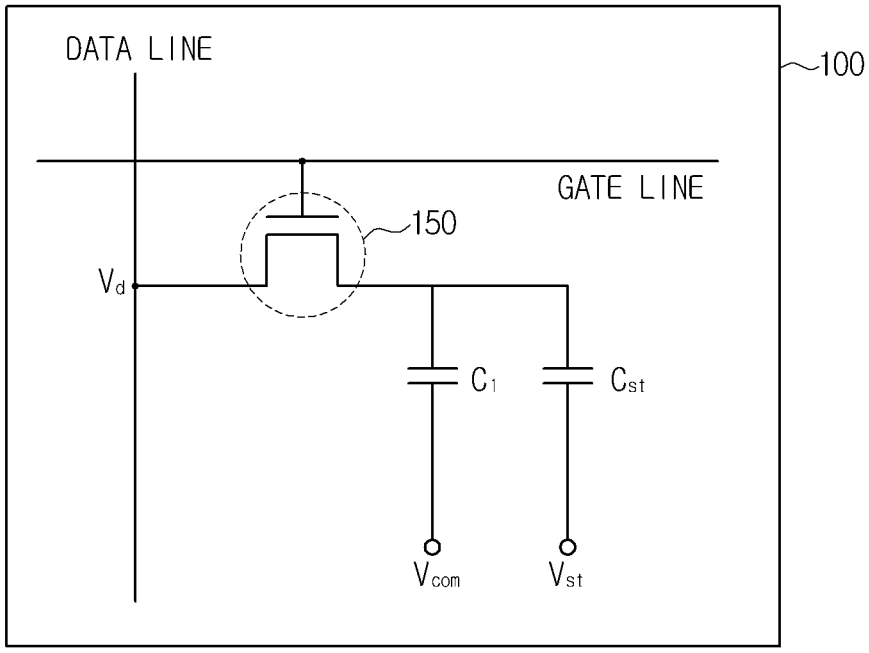
FIG. 2 is a schematic perspective view illustrating one pixel among a plurality of pixels.

A pixel will be explained in detail below with reference to FIG. 2. FIG. 2 is a schematic perspective view illustrating one pixel among a plurality of pixels.

A pixel includes a thin film transistor 150 having a source electrode and a gate electrode connected to a data line and a gate line respectively, a liquid crystal capacitor (C1) which is connected to the drain electrode of the thin film transistor 150, and a storage capacitor (Cst).

When the thin film transistor 150 is turned on after gate on voltage is applied to a gate line, the data voltage provided to the data line is applied to each pixel electrode (not shown) through the thin film transistor 150. The electric field, tantamount to the difference between pixel voltage and common voltage (Vcom) is applied to liquid crystal and light passes through with the transmissibility corresponding to the strength of the electric field.

Referring to FIG. 1 again, the timing controller 200 transmits the calibrated grayscale data of the current frame to the data driving unit 310 so that the panel unit 100 could work in the above-mentioned manner.

The timing controller 200 receives an external image signal (not shown) and processes the external image signal. More particularly, the timing controller 200 receives RGB (Red, Green, Blue) data, a data enable signal indicating the timing of a frame, synchronizing signal, and clock signal, and performs data processing such as redistributing timing using the received signals.

The timing controller 200 calibrates grayscale data of the Nth frame using the grayscale data of the current frame (refer to below as Nth frame) and the previous frame (refer to below as the N−2th frame, N−1th frame).

A grayscale data refers to a data provided to express black grayscale, white grayscale, and the grayscale between black and white grayscale by adjusting the transmissibility of liquid crystal. The timing controller 200 will be explained in detail below with reference to FIG. 3.

The timing controller 200 transmits the calibrated grayscale data of the Nth frame to the data driving unit 310.

The driving unit 300 drives the panel unit 100 using the calibrated grayscale data of the Nth frame which is output form the timing controller 200. The driving unit 300 comprises a data driving unit 310 and a gate driving unit 350.

The data driving unit 310 transforms the calibrated grayscale data of the Nth frame which is received from the timing controller 200 into data voltage and applies it to each data line.

The gate driving unit 350 applies gate on voltage to gate lines consecutively and turns on the thin film transistor 150 whose gate electrode is connected to gate line with gate on voltage.

By doing so, response times of liquid crystal may be improved using the calibrated grayscale data of the Nth frame and users are able to view a high quality image.

Figure 3:
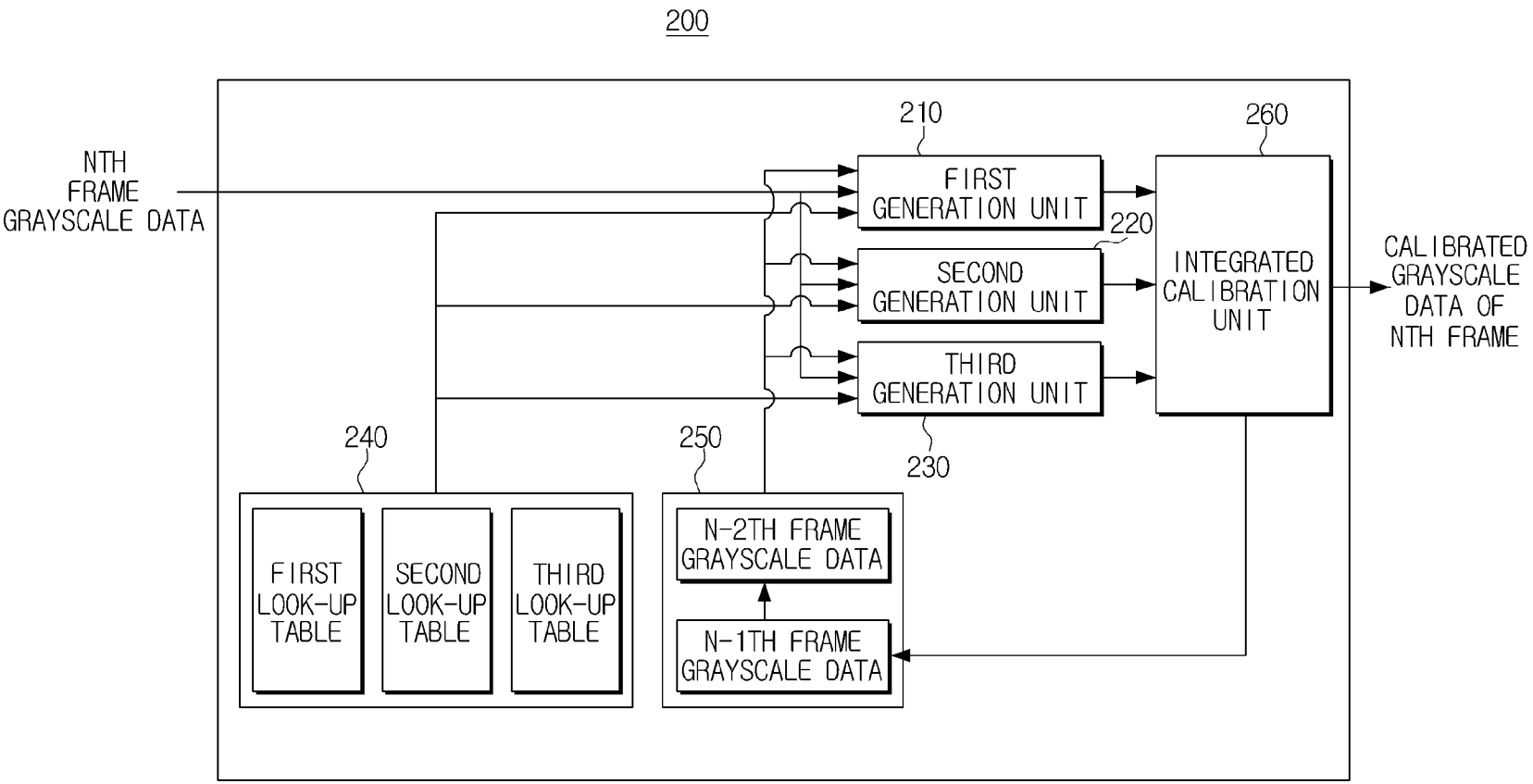
FIG. 3 is a detailed block diagram illustrating a timing controller according to an exemplary embodiment of the present invention.

FIG. 3 is a detailed block diagram illustrating the timing controller 200 according to an exemplary embodiment of the present invention. As shown in FIG. 3, the timing controller 200 comprises the first generation unit 210, the second generation unit 220, the third generation unit 230, the first storage unit 240, the second storage unit 250, and the integrated calibration unit 260.

The first generation unit 210, the second generation unit 220, and the third generation unit 230 receive the calibrated data of the Nth frame from the data driving unit 310 and generate the first calibration data, the second calibration data, and the third calibration data respectively.

The first generation unit 210 generates the first calibration data using an overdrive method. More particularly, the first generation unit 210 receives the grayscale data of the N−1th frame and Nth frame and generates the first calibration data using the first look-up table together with the received grayscale data of the N−1th frame and Nth frame.

The overdrive method refers to a method to improve response times by calibrating the grayscale data of the Nth frame using the grayscale data of the N−1th frame and Nth frame. The overdrive method is also known as Dynamic Capacitance Capture (DCC).

Although the duration time for one frame is 16.7 msec, it takes longer to change the alignment of liquid crystal of a certain pixel. Therefore, it takes more time than 16.7 msec to display the grayscale data that he or she wants to display and only after 16.7 msec has passed, the grayscale data may be displayed.

That is, it is impossible to display the grayscale data within 16.7 msec which is a duration time for one frame and in order to display the grayscale data on screen, the grayscale data need to be calibrated.

Figure 4:
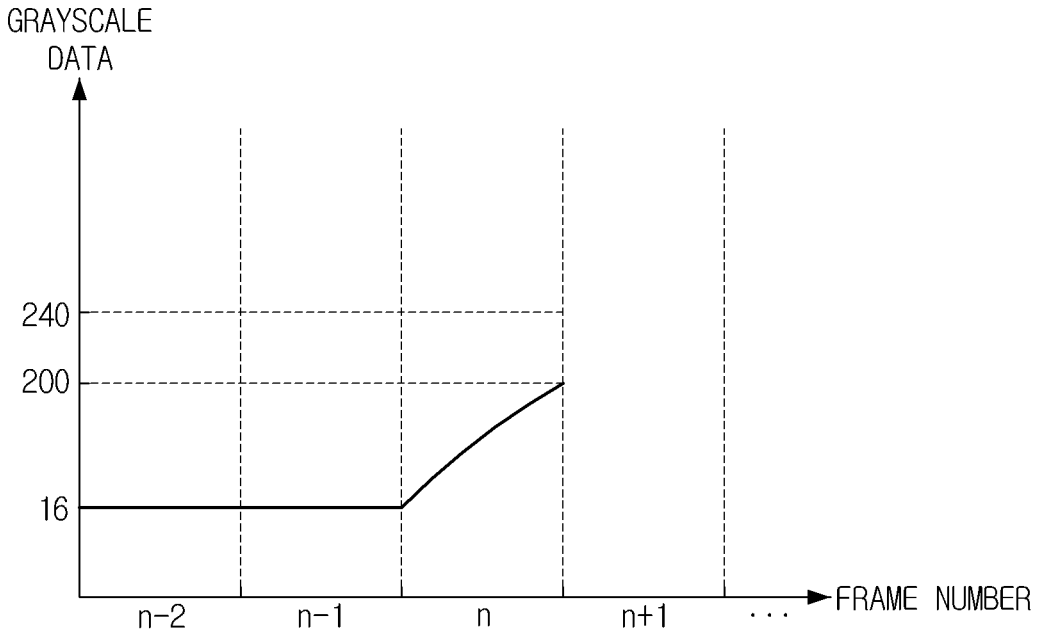
FIG. 4 is a schematic perspective view illustrating grayscale data which have not been calibrated.

Refer to the schematic perspective view in FIG. 4 for the grayscale data which have not been calibrated.

According to the illustration in FIG. 4, the grayscale data of the N−1th frame of a pixel are 16 and the target grayscale data of the Nth frame are 240. However, if the grayscale data of the Nth frame are not calibrated, the actual grayscale data of the Nth frame could not reach 240 and stay at 200 due to the slow response times of liquid crystal.

The target grayscale data refer to grayscale data displayed after the calibration of a grayscale data whereas the actual grayscale data refer to grayscale data which is actually displayed on screen regardless of calibration. In order to generate the target grayscale data, a grayscale data are calibrated using the overdrive method, a pre-tilt method, or an undershoot method.

Referring to FIG. 3 again, in order to improve response times and reduce delay times, under the overdrive method the grayscale data of the N−1th frame of a pixel are compared with the grayscale data of the Nth frame to calculate discrepancy between the two and the grayscale data of the Nth frame is calibrated to larger or smaller data based on the discrepancy.

More particularly, according to the overdrive method, the grayscale data level of the Nth frame increases if the grayscale data of the N-1th frame are lower than the grayscale data of the Nth frame while the grayscale data level of the Nth frame decreases if the grayscale data of the N-1th frame are higher than the grayscale data of the Nth frame.

Figure 5:
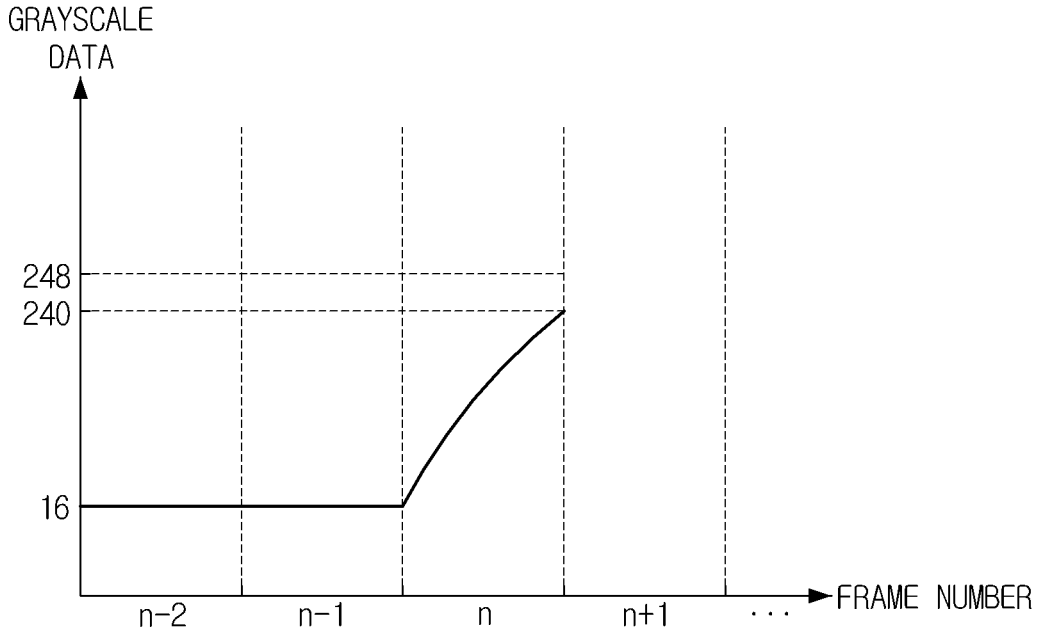
FIG. 5 is a schematic perspective view illustrating grayscale data after an overdrive method is performed.

This will be explained in detail with reference to FIG. 5. FIG. 5 is a schematic perspective view illustrating the grayscale data after the overdrive method is performed. For better understanding, FIG. 5 presents an example where the grayscale data level of the Nth frame increases as the grayscale data of the N−1th frame are lower than the grayscale data of the Nth frame.

As shown in FIG. 5, if the grayscale data of the N−1th frame are 16 and the target grayscale data of the Nth frame are 240, the calibrated data of the Nth frame become 248 under the overdrive method.

That is, if the grayscale data of the Nth frame are calibrated to 248, the actual grayscale data of the Nth frame become consistent with the target grayscale data of 240 due to slow response times.

On the other hand, the calibrated grayscale data of the Nth frame, 248 are stored in the first storage unit 240 as the first look-up table. FIG. 6 is a schematic perspective view illustrating the first look-up table used for the overdrive method.

Referring to FIG. 6, the grayscale data of the N−1th frame are illustrated in a row while the grayscale data of the Nth frame are illustrated in a column.

As explained above, if the grayscale data of the N−1th frame are 16 and the grayscale data of the Nth frame are 240, the calibrated grayscale data of the Nth frame become 248 to obtain the target grayscale data of the Nth frame, 240.

In short, the overdrive method is a method designed to adjust the calibrated grayscale data of the Nth frame higher or lower than the target grayscale data in order to obtain the target grayscale data.

Referring to FIG. 3 again, the first generation unit 210 transmits the first calibration data, which are the calibrated grayscale data, to the integrated calibration unit 260.

The second generation unit 220 generates the second calibration data using the pre-tilt method. More particularly, the second generation unit 220 receives the grayscale data of the N−2th frame, the grayscale data of the N−1th frame, and the grayscale data of the Nth frame, and generates the second calibration data using the second look-up table along with the received grayscale data of the N−2th frame, the grayscale data of the N−1th frame, and the grayscale data of the Nth frame.

The pre-tilt method refers to a method designed to improve response times of liquid crystal by calibrating the grayscale data of the N−1th frame using the grayscale data of the N−2th frame, N−1th frame, and the Nth frame.

More particularly, according to the pre-tilt method, the grayscale data level of the N−1th frame increases if the grayscale data of the N−1th frame are lower the grayscale data of the Nth frame whereas the grayscale data level of the N−1th frame decreases if the grayscale data of the N−1th frame are higher than the grayscale data of the Nth frame.

While the overdrive method is designed to improve response times of liquid crystal by calibrating only the grayscale data of the Nth frame, the pre-tilt method is designed to improve response times by calibrating the grayscale data of the N−1th frame and thus, ultimately calibrating the grayscale data of the Nth frame.

According to the pre-tilt method, before the grayscale data of the N−1th frame become the grayscale data of the Nth frame, higher or a lower grayscale data than the original grayscale are applied. Applying a higher or a lower grayscale data to the grayscale data of the N−1th frame in advance allows elasticity against the up and down of the grayscale data, making it possible to obtain the target grayscale data of the Nth frame.

Figure 7:
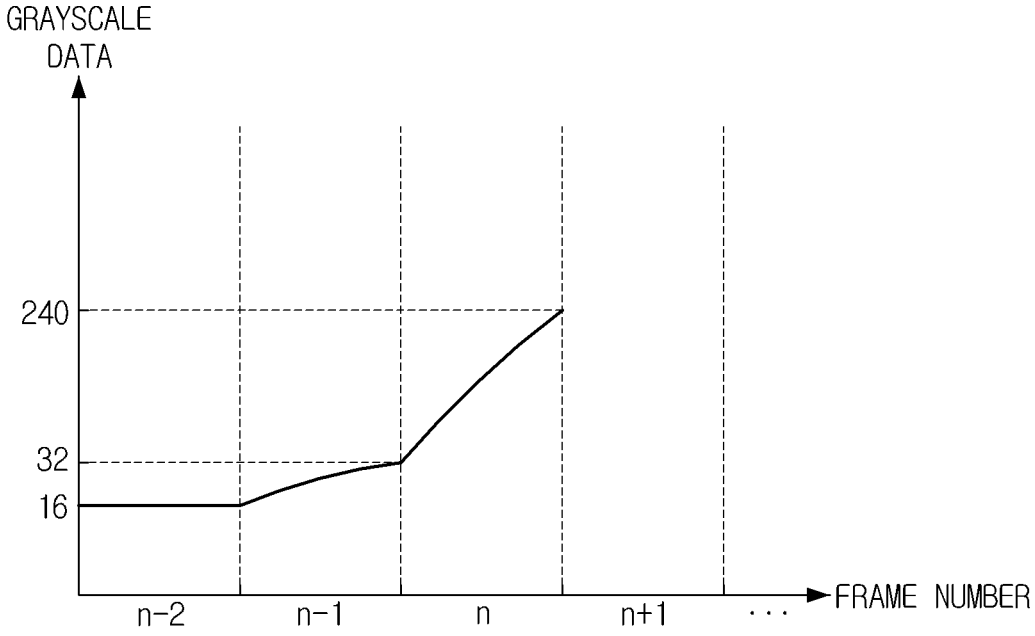
FIG. 7 is a schematic perspective view illustrating grayscale data after a pre-tilt method is performed.

This will be explained in detail with reference to FIG. 7. FIG. 7 is a schematic perspective view illustrating the grayscale data after the pre-tilt method is performed. For better understanding, FIG. 7 presents an example where the grayscale data level of the N−1th frame increases as the grayscale data of the N−1th frame is lower than the grayscale data of the Nth frame.

In FIG. 7, the grayscale data of the N−2th frame of a certain pixel are set to be 16, the grayscale data of the N−1th frame, also 16, and the grayscale data of the Nth frame are set to be 240. In this case, if the grayscale data of the Nth frame have not been calibrated at all, the grayscale data might not be changed swiftly from 16 to 240 due to low response times of liquid crystal, resulting in lower than 240 of the grayscale data of the Nth frame.

As shown in FIG. 7, according to the pre-tilt method, the grayscale data of the N−1th frame of a certain pixel are calibrated from 16 to 32 in order to make the target grayscale data of the Nth frame reach 240.

That is, if the grayscale data of the N−1th frame are calibrated to 32, not an originally calibrated grayscale data 16, upward elasticity is created, making it possible for the target grayscale data reach 240. The calibrated grayscale data of the N−1th frame, 32, are stored in the second look-up table.

In short, the pre-tilt method is a method designed to ultimately calibrate the grayscale data of the Nth frame by increasing or decreasing the grayscale data of the N−1th frame in order to obtain the desired grayscale data.

Referring to FIG. 3 again, the second generation unit 220 transmits the second calibration data, which are the calibrated grayscale data, to the integrated calibration unit 260.

The third generation unit 230 generates the third calibration data using the undershoot calibration method. More particularly, the third generation unit 230 receives the grayscale data of the N−1th frame and the Nth frame and generates the third calibration data using the third look-up table together with the received grayscale data of the N−1th frame and the Nth frame.

The undershoot calibration method refers to a method designed to improve response times of liquid crystal by calibrating the grayscale data of the Nth frame using the grayscale data of the N−1th frame and the Nth frame.

More particularly, according to the undershoot calibration method, the grayscale data level of the Nth frame decreases if the grayscale data of the N−1th frame are lower than that of the Nth frame while the grayscale data level of the Nth frame increases if the grayscale data of the N−1th frame are higher than that of the Nth frame.

According to the above-mentioned explanation, the calibrated grayscale data of the Nth frame are input when applying the overdrive method. However, a ghost and undershoot effect may occur when applying the overdrive method, which means the grayscale data of the Nth frame are out of the desired grayscale data.

Figure 8:
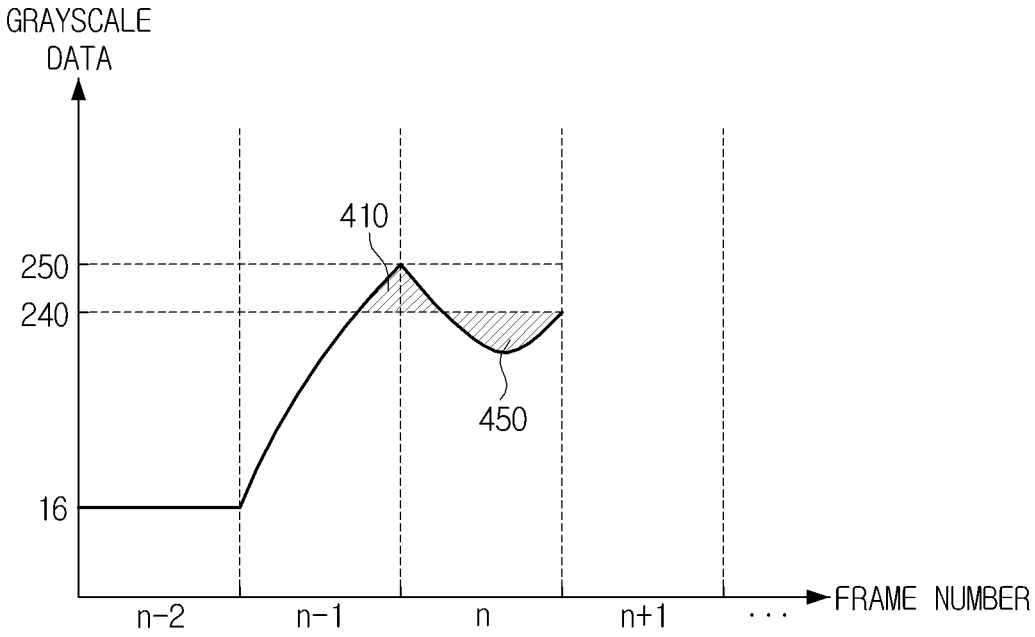
FIG. 8 is a schematic perspective view illustrating ghost and undershoot effects observed when the overdrive method is performed.

FIG. 8 is a schematic perspective view illustrating the ghost and undershoot effect observed when the overdrive method is performed. For better understanding, FIG. 8 presents an example where the grayscale data of the Nth frame decrease as the grayscale data of the N−1th frame is lower than that of the Nth frame If the grayscale data of the N−1th frame are 16 and the target grayscale data of the Nth frame are 240, the calibrated grayscale data of the Nth frame become 248 using the first look-up table in FIG. 6. However, as shown in FIG. 8, the ghost effect 410 may occur, where the actual grayscale data of the Nth frame reaches up to 250 and the undershoot effect 450 may occur where the actual grayscale data of the Nth frame drop below 240. Those effects are caused by the abnormal movements of liquid crystal according to the change in the alignment of liquid crystal after the calibrated grayscale data are applied.

Under the undershoot calibration method, the calibrated grayscale data of the Nth frame are set to be lower than the target grayscale data in order to prevent such ghost effect 410 and undershoot effect 450.

For instance, if the grayscale data of the N−1th frame are 16 and the target grayscale data of the Nth frame are 240, the calibrated grayscale data of the Nth frame may be 248 under the overdrive method. However, under the undershoot calibration method, the calibrated grayscale data of the Nth frame are set to be 226 which are lower than the target grayscale data of the Nth frame, 240 in order to prevent the ghost effect 410 and the undershoot effect 450.

The calibrated grayscale data of the Nth frame, 226 are stored as the third look-up table. FIG. 9 is a schematic perspective view illustrating the third look-up table used to address the undershoot effect.

Referring to FIG. 9, the grayscale data of the N−1th frame are illustrated in a row while the grayscale data of the Nth frame are illustrated in a column.

As explained above, if the grayscale data of the N−1th frame are 16 and the grayscale data of the Nth frame are 240, the calibrated grayscale data of the Nth frame become 226 in order to prevent the ghost effect 410 and the undershoot effect 450.

In short, the undershoot calibration method refers to a method designed to increase or decrease the grayscale data of the Nth frame in order to prevent the ghost effect 410 and the undershoot effect 450.

Referring to FIG. 3 again, the third generation unit 230 transmits the third calibration data, which are the calibrated grayscale data, to the integrated calibration unit 260.

The first look-up table, the second look-up table, and the third look-up table which have been mentioned above are stored in the first storage unit 240.

The first storage unit 240 stores not only the first, second, and the third look-up tables but also program information and weighted value information required to control a display apparatus.

The weighted value information refers to information required to use the first, the second, and the third calibration data adaptively which are generated from the first generation unit 210, the second generation unit 220, and the third generation unit 230, respectively. Detailed explanation on this will be provided below with the integrated calibration unit 260.

The first storage unit 240 transmits the first look-up table to the first generation unit 210, the second look-up table to the second generation unit 220 and the third look-up table to the third generation unit 230.

The second storage unit 250 stores the grayscale data of the N−2th frame and the N−1th frame. The second storage unit 250 which stores the grayscale data of the previous frame transmits the grayscale data of the N−2th frame and N−1th frame to the first generation unit 210, the second generation unit 220, and the third generation unit 230.

As the first generation unit 210 which calibrates the grayscale data of the Nth frame using the overdrive method and the third generation unit 230 which calibrates the grayscale data of the Nth frame using the undershoot calibration method do not use the grayscale data of the N−2th frame, it is possible to make the second storage unit 250 transmit the grayscale data of the N−2th frame only to the second generation unit 220.

The grayscale data of the N−2th frame are renewed as the grayscale data of the N−1th frame and the grayscale data of the N−1th frame are renewed as the grayscale data of the Nth frame which have been transmitted from the integrated calibration unit 260. That is, after one frame has passed, the current frame becomes N+1th and the previous frame becomes the Nth frame and the N−1th frame.

The integrated calibration unit 260 generates the calibrated grayscale data of the final Nth frame using the first, the second, and the third calibration data received from the first generation unit 210, the second generation unit 220, and the third generation unit 230, respectively.

More particularly, the integrated calibration unit 260 adds weighted values to the first, the second, and the third calibration data and calibrates the grayscale data of the Nth frame by summing up the first calibration data to the third calibration data to which weighted values are added.

For instance, if calibration is performed applying 50% of the overdrive method, 30% of the pre-tilt method, and 20%, the integrated calibration unit 260 multiplies the first calibration data by a weighted value of 0.5, the second calibration data by a weighted value of 0.3, and the third calibration data by a weighted value of 0.2. The integrated calibration unit 260 generates the final calibrated grayscale data of the Nth frame by summing up the multiplied first to the third calibration data.

However, the foregoing exemplary embodiments and advantages are merely exemplary and are not to be construed as limiting the present invention. Accordingly, the percentage of each method, that is, the overdrive method, the pre-tilt method, and the undershoot method may be set differently by a user.

Also, the percentages which are applied depending on the values of the first calibration data, the second calibration data, and the third calibration data are stored in storage units such as the first storage unit 240, the second storage unit 250 as a look-up table. For instance, if the first calibration data, the second calibration data, and the third calibration data are 140, 142, 138 respectively and if the overdrive method of 50%, the pre-tilt method of 30%, and the undershoot calibration method of 20% are applied, the first to the third calibration data values and the percentage of the three calibration methods may be stored as a look-up table when calibration is performed in a best possible way.

That is, each calibration data value and the percentage of each calibration method corresponding to each calibration data value may be predetermined by an experiment or so.

The integrated calibration unit 260 transmits the final calibrated grayscale data of the Nth frame to the driving unit 300 and the second storage unit 250. The final calibrated grayscale data of the Nth frame which is transmitted to the driving unit 300 are used to calibrate the image of the Nth frame and the final calibrated grayscale data of the Nth frame which is transmitted to the second storage unit 250 are used to calibrate the image of the N+1th frame.

Figure 10:
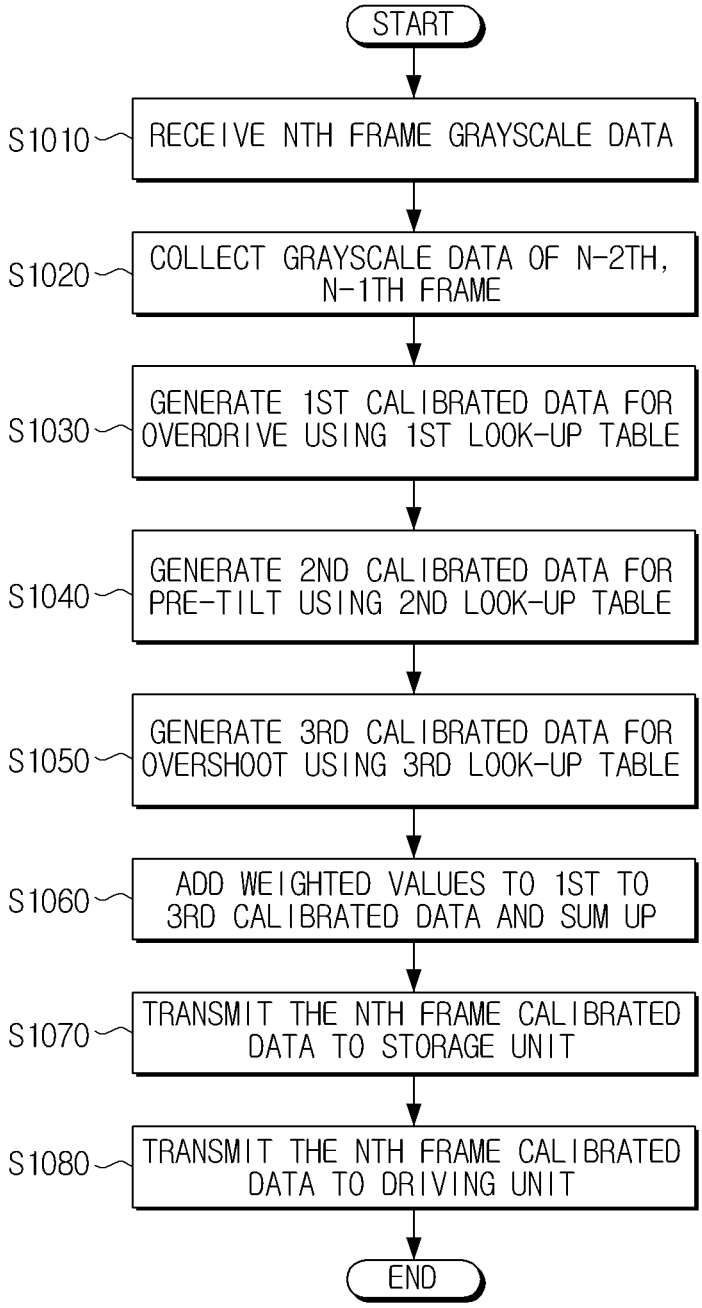
FIG. 10 is a flowchart provided to explain a method for driving a panel using the display apparatus according to an exemplary embodiment of the present invention.

FIG. 10 is a flowchart provided to explain a method for driving a panel using the display apparatus according to an exemplary embodiment of the present invention.

First of all, the first generation unit 210, the second generation unit 220, and the third generation unit 230 receive the Nth frame grayscale data of an external image (S1010).

The first generation unit 210, the second generation unit 220, and the third generation unit 230 receive the N−1th frame grayscale data from the second storage unit 250 and the second generation unit 220 receives the N−2th frame grayscale data from the second storage unit 250.

The first generation unit 210 generates the first calibration data for the overdrive method using the first look-up table together with the received N−1th frame grayscale data and the Nth frame grayscale data (S1030).

The second generation unit 220 generates the second calibration data for the pre-tilt method using the second look-up table together with the received N−2th frame grayscale data, the N−1th frame grayscale data, and the Nth frame grayscale data (S1040).

The third generation unit 230 generates the third calibration data for the undershoot method using the third look-up table together with the received N−1th frame grayscale data and the Nth frame grayscale data (S1050).

The first generation unit 210, the second generation unit 220, and the third generation unit 230 transmit the first calibration data, the second calibration data and the third calibration data to the integrated calibration unit 260. The integrated calibration unit 260 adds weighted values and sums up the first, the second, and the third calibration data to generate the final grayscale data of the Nth frame (S1060).

The integrated calibration unit 260 transmits the generated final grayscale data of the Nth frame to the second storage unit 250 (S1070) and to the driving unit 300 (S1080).

By doing so, response times of liquid crystal may be improved, making it possible to provide a user with high quality image.

In conclusion, as response times of liquid crystal are improved with the calibration of the grayscale data of the current frame, a user may be able to view a high quality image.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A display apparatus for calibrating grayscale data of a current frame using the grayscale data of a previous frame and the current frame, comprising:

a timing controller which calibrates the grayscale data of the current frame by changing the grayscale data of the current frame to first calibration data, second calibration data, and third calibration data using an overdrive method, a pre-tilt method, and an undershoot method and calculating the first calibration data, the second calibration data and the third calibration data, wherein the timing controller adds weighted values to the first calibration data, the second calibration data and the third calibration data and sums up the first calibration data, the second calibration data and the third calibration data to which weighted values are added to calibrate the grayscale data of the current frame; and a driving unit which drives a panel using the calibrated grayscale data of the current frame, wherein the first calibration data, the second calibration data and the third calibration data are determined based on one of a plurality of previously stored look-up tables, and wherein the first calibration data corresponds to the overdrive method, the second calibration data corresponds to the pre-tilt method, and the third calibration data corresponds to the undershoot method.

2. The display apparatus as claimed in claim 1, further comprising a storage unit which stores the grayscale data of the previous frame, wherein the timing controller stores the calibrated grayscale data of the current frame in the storage unit.

3. The display apparatus as claimed in claim 1, wherein, according to the overdrive method, a level of the grayscale data of the current frame increases if the grayscale data level of the previous frame is lower than the grayscale data level of the current frame, and the level of the grayscale data of the current frame decreases if the grayscale data level of the previous frame is higher than the grayscale data level of the current frame.

4. The display apparatus as claimed in claim 1, wherein, according to the pre-tilt method, a level of the grayscale data of the previous frame increases if the grayscale data level of the previous frame is lower than the grayscale data level of the current frame, and the level of the grayscale data of the previous frame decreases if the grayscale data level of the previous frame is higher than the grayscale data level of the current frame.

5. The display apparatus as claimed in claim 1, wherein, according to the undershoot method, a level of the grayscale data level of the current frame decreases if the grayscale data level of the previous frame is lower than the grayscale data level of the current frame, and the level of the grayscale data of the current frame increases if the grayscale data level of the previous frame is higher than the grayscale data level of the current frame.

6. The display apparatus as claimed in claim 1, wherein the display apparatus is a liquid crystal display device.

7. The display apparatus as claimed in claim 1, wherein if the current frame is an Nth frame, the first calibration data and the third calibration data are generated using the Nth frame and a N−1th frame; and the second calibration data is generated using the Nth frame, the N−1th frame, and a N−2th frame.

8. The display apparatus as claimed in claim 1, wherein the plurality of look up tables include a first previously stored look-up table used for the overdrive method, a second previously stored look-up table used for the pre-tilt method, and a third previously stored look-up table used for the undershoot method.

9. A method for driving a panel to calibrate grayscale data of a current frame using the grayscale data of a previous frame and the current frame, the method comprising:

changing the grayscale data of the current frame to first calibration data, second calibration data, and third calibration data using an overdrive method, a pre-tilt method, and an undershoot method;

calibrating the grayscale data of the current frame by calculating the first calibration data, the second calibration data and the third calibration data;

adding weighted values to the first calibration data, the second calibration data and the third calibration data;

calibrating the grayscale data of the current frame by summing up the first calibration data, the second calibration data and the third calibration data to which weighted values are added; and driving a panel using the calibrated grayscale data of the current frame, wherein the first calibration data, the second calibration data and the third calibration data are determined based on one of a plurality of previously stored look-up tables, and wherein the first calibration data corresponds to the overdrive method, the second calibration data corresponds to the pre-tilt method and the third calibration data corresponds to the undershoot method.

10. The method as claimed in claim 9, further comprising:

storing the calibrated grayscale data of the current frame once the grayscale data of the current frame have been calibrated.

11. The method as claimed in claim 9, wherein the changing comprises:

generating the first calibrated data by increasing a level of the grayscale data of the current frame if the grayscale data level of the previous frame is lower than the grayscale data level of the current frame, and decreasing the level of the grayscale data of the current frame if the grayscale data level of the previous frame is higher than the grayscale data level of the current frame.

12. The method as claimed in claim 9, wherein the changing comprises:

generating the second calibrated data by increasing a level of the grayscale data of the previous frame if the grayscale data level of the previous frame is lower than the grayscale data level of the current frame, and decreasing the level of the grayscale data of the previous frame if the grayscale data level of the previous frame is higher than the grayscale data level of the current frame.

13. The method as claimed in claim 9, wherein the changing comprises:

generating the third calibrated data by decreasing a level of the grayscale data of the current frame if the grayscale data level of the previous frame is lower than the grayscale data level of the current frame, and increasing the level of the grayscale data of the current frame if the grayscale data level of the previous frame is higher than the grayscale data level of the current frame.

14. The method as claimed in claim 9, wherein if the current frame is an Nth frame, the first calibration data and the third calibration data are generated using the Nth frame and a N−1th frame; and the second calibration data is generated using the Nth frame, the N−1th frame, and a N−2th frame.

15. The method as claimed in claim 9, wherein the plurality of look up tables include a first previously stored look-up table used for the overdrive method, a second previously stored look-up table used for the pre-tilt method, and a third previously stored look-up table used for the undershoot method.

16. A timing controller to calibrate grayscale data of a current frame using the grayscale data of a previous frame and the current frame, comprising:

a first generation unit which generates first calibrated grayscale data using an overdrive method;

a second generation unit which generates second calibrated grayscale data using a pre-tilt method;

a third generation unit which generates third calibrated grayscale data using an undershoot method; and an integrated calibration unit which calibrates the grayscale data of the current frame using the first calibration data, the second calibration data and the third calibration data which are output from the first generation unit, the second generation unit and the third generation unit, respectively, wherein the integrated calibration unit adds weighted values to the first calibration data, the second calibration data and the third calibration data and sums up the first calibration data, the second calibration data and the third calibration data to which weighted values have been added, wherein the first calibration data, the second calibration data and the third calibration data are determined based on one of a plurality of previously stored look-up tables, and wherein the first calibration data corresponds to the overdrive method, the second calibration data corresponds to the pre-tilt method, and the third calibration data corresponds to the undershoot method.

17. The timing controller as claimed in claim 16, comprising a storage unit which stores the grayscale data of the previous frame, wherein the integrated calibration unit directs the calibrated grayscale data of the current frame to be stored in the storage unit.

18. The timing controller as claimed in claim 16, wherein if the current frame is an Nth frame, the first generation unit and the third generation unit generate the first calibration data and the third calibration data, respectively, using the Nth frame and a N−1th frame; and the second generation unit generates the second calibration data using the Nth frame, the N−1th frame, and a N−2th frame.

19. The timing controller as claimed in claim 16, further comprising:

a storage unit which stores levels of the first calibration data level, the second calibration data and the third calibration data based on the grayscale data of the previous frame and the grayscale data of the current frame as a look-up table.

20. The timing controller as claimed in claim 16, wherein the plurality of look up tables include a first previously stored look-up table used for the overdrive method, a second previously stored look-up table used for the pre-tilt method, and a third previously stored look-up table used for the undershoot method.

* * * * *